US006374413B1

(12) United States Patent
Magee

(10) Patent No.: US 6,374,413 B1
(45) Date of Patent: Apr. 23, 2002

(54) RADAR REFLECTIVE GARMENT

(76) Inventor: Terence Magee, 1658 McCarren Way, Santa Rosa, CA (US) 95401

( * ) Notice: Subject to any disclaimer, the term of this patent is extended or adjusted under 35 U.S.C. 154(b) by 0 days.

(21) Appl. No.: 09/638,440

(22) Filed: Aug. 14, 2000

(51) Int. Cl.[7] ..... A41B 1/12; A41D 1/12

(52) U.S. Cl. ..... 2/69; 2/1; 2/456; 2/2.14; 2/102; 2/900

(58) Field of Search ..... 2/1, 456, 2.14, 2/69, 102, 900

(56) References Cited

U.S. PATENT DOCUMENTS 3,849,802 A * 11/1974 Govaars ..... 2/81
4,017,908 A * 4/1977 Murnane ..... 2/114
4,181,993 A * 1/1980 McDaniel ..... 441/108
4,274,158 A * 6/1981 Pogorski et al. ..... 2/2.16
4,420,521 A * 12/1983 Carr ..... 428/74
4,420,757 A * 12/1983 Ebneth et al. ..... 343/912
4,677,010 A * 6/1987 Selwyn ..... 428/41.6
5,184,968 A * 2/1993 Michalochick et al. ..... 441/116

* cited by examiner

*Primary Examiner*—John J. Calvert
*Assistant Examiner*—Robert Muromoto, Jr.
(74) *Attorney, Agent, or Firm*—Risto A. Rinne, Jr.

(57) ABSTRACT

An apparatus for the detection of a wearer includes a first inner layer that is adapted to reflect a portion of radar energy back toward its source. A second outer layer is disposed over the first inner layer and it provides a texture and visual appearance that is preferred. For some applications, an especially easy to spot brightly colored visual appearance is preferred for the second outer layer. For other applications, a more subdued visual appearance is preferred. For still other applications, a camouflage appearance is preferred. A space is provided intermediate the first inner layer and the second outer layer accordingly to a modification and an additional material is used to fill the space. The additional material must be substantially transparent to radar energy and it may provide additional floatation capability or additional insulating capability or both to the garment, as desired.

15 Claims, 1 Drawing Sheet

RADAR REFLECTIVE GARMENT

RELATED APPLICATION

This application is related to another patent application by the same inventor entitled "Visible Floatation Device" currently pending that was filed on Jun. 15, 2000, application Ser. No. 09/595,000.

BACKGROUND OF THE INVENTION

1. Field of the Invention

The present invention, in general relates to vests and other types of garments and more particularly, to garments that are able to reflect radar to aid in locating a wearer thereof.

Hikers, hunters, and boating enthusiasts sometimes encounter mishap and require rescue. For example, a hiker can fall and become injured and may therefore be unable to move or to summon help.

Similarly, a hunter can experience a mishap and be in need of rescue. Depending on the nature of the problem the person may not be able to assist in any capacity that would serve to aid in their detection and rescue.

A person on a boat or ship is in danger of falling overboard or of being cast overboard should the boat or ship sink. A person afloat in the water is especially difficult to see. The chop of the waves tends to obscure them from vision.

To any person injured and in need of rescue the most effective means to locate a person is generally by air. However, a person can easily be lost on the ground surface or in the water and be difficult to spot visually from the air. A person afloat in the ocean can appear as a tiny insignificant spot that is virtually invisible to the eye amid the enormous expanse of water.

A person stranded in the wilderness can be camouflaged or completely obscured by tree cover and therefore be totally hidden to sight from the air.

It is desirable to provide a device that can be worn and which would reflect radar and therefore, provide an optimum strength signal return (i.e., echo) for detection by aircraft.

It is also desirable that the device be highly visible to the eye. If, for example, a hunter is wearing it and his visual detection by other hunters ensures his safety then it must be easy to spot less the wearer be mistaken for a game animal.

Conversely, for other applications a wearer may not wish to visually stand out. He or she may, in fact, prefer a garment that blends in and is visually neutral in appearance yet which can be of use in locating the wearer by radar if necessary.

Furthermore, a hunter may wish to have the security of wearing a garment that can be spotted by radar yet which is camouflaged and therefore virtually invisible to the eye. Clearly, the difficulty in spotting a disabled hunter who is wearing camouflage apparel from the air is significant. Such a person would, heretofore, be virtually impossible to spot from the air or even by ground observation. One could literally step on a camouflaged person before being able to detect him or her.

Heretofore, the conflicting needs of promoting radar detectability and also of satisfying visual aesthetics have not been met.

Accordingly, there exists today a need for a radar reflective garment that can be worn and which can aid in rescue.

2. Description of Prior Art

Vest, blankets, and safety markers are, in general, known. For example, the following patents describe various types of these devices:

U.S. Pat. No. 3,708,810 to Merikallio, Jan. 9, 1973;

U.S. Pat. No. 3,877,096 to Scesney, Apr. 15, 1975;

U.S. Pat. No. 4,498,882 to Evert, Feb. 12, 1985;

U.S. Pat. No. 5,421,287 to Yonover, Jun. 6, 1995; and

U.S. Pat. No. 5,516,233 to Courtney, May 14, 1996.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a radar reflective garment that is of use in locating a wearer.

It is also an important object of the invention to provide a radar reflective garment that reflects radar.

Another object of the invention is to provide a radar reflective garment that improves detection by radar.

Still another object of the invention is to provide a radar reflective garment that includes a preferred visual appearance.

Still yet another object of the invention is to provide a radar reflective garment that includes a visual appearance that is highly visible.

Yet another important object of the invention is to provide a radar reflective garment that includes a visual appearance that is selected to match the requirements of the wearer.

Still yet another important object of the invention is to provide a radar reflective garment that includes two layers.

One further object of the invention is to provide a radar reflective garment that includes a first layer that reflects radar and a second layer that is of a desired visual appearance.

One further important object of the invention is to provide a radar reflective garment that includes a first inner layer that reflects radar and a second outer layer that is disposed over the first inner layer and which includes a desired visual appearance.

One still further object of the invention is to provide a radar reflective garment that provides protection from the elements.

One still further important object of the invention is to provide a radar reflective garment that serves as a wind breaker.

One yet further object of the invention is to provide a radar reflective garment that can be used as a floatation device.

One yet further important object of the invention is to provide a radar reflective garment that can be used to provide added insulation from ambient conditions for the wearer.

One yet further especially important object of the invention is to provide a radar reflective garment that is difficult to spot visually yet which enhances detection by radar.

One still further especially important object of the invention is to provide a radar reflective garment that includes a difficult to spot camouflage outer appearance yet which is detectable by radar.

Briefly, a radar reflective garment that is constructed in accordance with the principles of the present invention has a first inner layer that is formed of a flexible material that reflects radar. A second outer layer is disposed over the first inner layer. The second outer layer includes a preferred visual appearance. The garment, according to a preferred embodiment, is a vest. The garment may also function as a windbreak. According to a modification, additional material may be disposed intermediate the first and second layers. If the additional material aids in floatation, the radar reflective garment is adapted to function as a floatation device. If the additional material aids in the retention of heat, the radar reflective garment is adapted to function as an insulating garment.

DETAILED DESCRIPTION OF THE INVENTION

Figure 1:
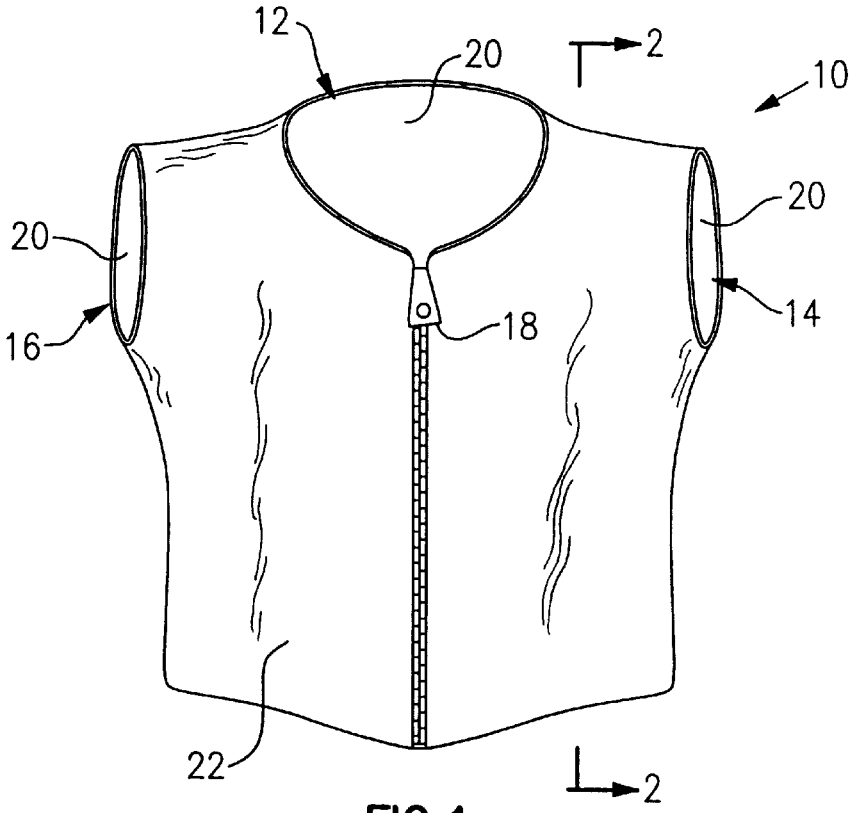
FIG. 1 is a view in perspective of a radar reflective garment.
Figure 2:
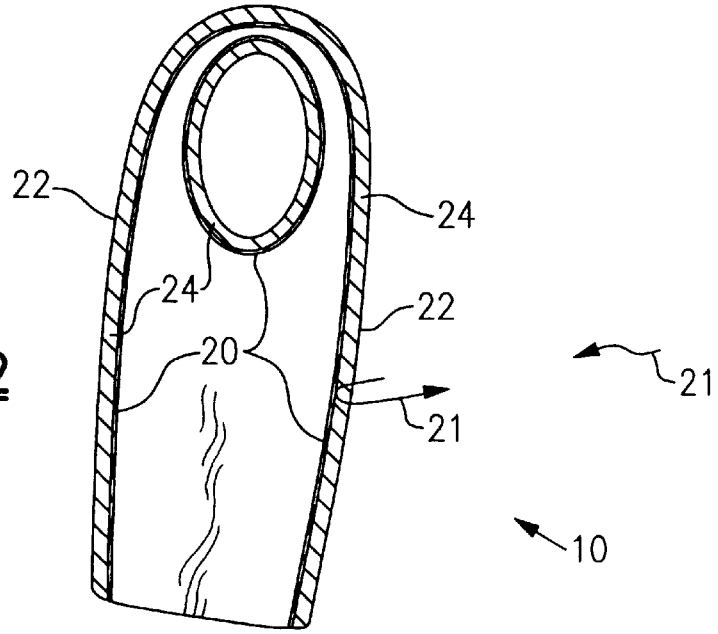
FIG. 2 is a cross sectional view of the garment of FIG. 1 taken along the line 2—2.

Referring to FIG. 1 and on occasion to FIG. 2, is shown, a radar reflective garment, identified in general by the reference numeral 10.

The garment 10, as shown, is a vest, however other types of garments having any preferred size or shape may be used, as desired.

The garment 10 includes a first opening 12 for a neck of a wearer (not shown) to pass through and a second opening 14 for an arm of the wearer to pass through and a third opening 16 for a remaining arm of the wearer to pass through.

A zipper opening 18 is provided down the front length of the garment 10 to aid in applying or removing it. Of course, other means may be provided to apply or to attach and detach the garment 10 from the wearer, such as Velcro or buttons, or if preferred it may simply include a pull-over type of configuration.

The garment 10 includes a first inner layer 20 that is formed of a flexible material which reflects radar energy 21. A polymeric film which includes on one of its faces metalization is a material that is especially well suited for this purpose, although any material that is flexible and which enhances the ability of the garment 10 to reflect radar energy 21 back to the source may potentially be used to form the first inner layer 20.

The first inner layer 20 is also useful to prevent wind from passing through the garment 10. Accordingly, use of the first inner layer 20 provides utility when the garment 10 is worn as a windbreak.

The garment 10 includes a second outer layer 22 that includes any preferred visual appearance or texture. The second outer layer 22 is disposed over the first inner layer 20.

If the first inner layer 20 is formed of a polymeric film which includes on one of its faces metalization, it tends to have a smooth, glossy appearance. The wearer may not prefer this particular appearance (or feel or sound of it as it flexes) and so any texture or visual appearance may be obtained by the use of the second outer layer 22.

For example, the second outer layer 22 may be brightly colored such as orange or yellow to aid in spotting the person.

Conversely, the garment 10 may include a camouflage pattern for the second outer layer 22 that actually is useful to visually conceal the wearer. This is useful in certain types of hunting situations.

Accordingly, the garment 10 that is provided (when camouflage is used to form the second outer layer 22) is both highly visible (i.e., reflective to radar energy 21) while simultaneously being substantially difficult to detect visually.

Similarly, any preferred appearance to match or coordinate with any other type of a garment (not shown) may also be selected for the second outer layer 22. Accordingly, any aesthetic need can be satisfied by the garment 10 which would therefore tend to promote its use by more fashion conscious wearers.

The second outer layer 22 may be disposed a predetermined distance away from the first inner layer 20 so as to create a space therebetween.

A quantity of an additional material 24 is placed intermediate the first inner layer 20 and the second outer layer 22, as desired.

The additional material 24 is used to fill the space that is created intermediate the first inner layer 20 and the second outer layer 22.

The additional material 24 is selected so as not to absorb radar energy 21 but rather to permit it to substantially pass through itself, contact the first inner layer 20, off of which it is then substantially reflected. The reflected radar energy 21 then passes once again back through the additional material 24 and out through the second outer layer 22 in a general direction back toward its source and subsequent detection of the wearer.

A plastic foam is a possible material for use as the additional material 24 because it does not substantially absorb radar energy 21. Other substances may also be used for the additional material 24, as desired.

When a material such as a plastic foam is used as the additional material 24, it provides two further benefits. First, the plastic foam provides additional floatation.

Accordingly, the garment 10 may be used as a radar reflective "floatation" device. As such it is especially well suited to boating enthusiasts and for all manner of water sports.

The plastic foam also provides an ability to insulate the wearer from the ambient surroundings. This is true regardless as to whether the ambient surroundings include air or water (i.e., whether the wearer is in the water or is disposed on land).

Accordingly, the garment 10 may be used as a radar reflective "insulating" device. This is useful both on land and in water and includes countless applications not mentioned herein. For example, both cross-country and downhill (i.e., alpine) snow skiers may benefit in that their detectability is enhanced as they wear a garment that is intended to also keep them warm and in style.

An especially useful benefit is also provided in that a downhill skier who becomes trapped in an avalanche and hidden from view may still be visible from the air (or ground) to radar. This could dramatically speed rescue and serve to save lives.

If preferred, the space intermediate the first inner layer 20 and the second outer layer 22 can be eliminated so as to form a thinner version of the garment 10.

In this case the first inner layer 20 and the second outer layer 22 are placed adjacent with respect to each other and may, if preferred, be bonded (i.e., attached) to each other.

According to a modification, the second outer layer 22 is provided as the reverse side of the first inner layer. For example, if the first inner layer 20 is formed of a polymeric film which includes on one of its faces metalization, then the second outer layer 22 is the coloring that is applied to the exterior surface of the. Polymeric film which includes on one of its faces metalization The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A radar reflective garment that is adapted for wear, wherein the improvement comprises: a portion of a layer of flexible material disposed in said garment that is adapted to reflect a portion of incident radar energy back toward its source, said portion of a layer of flexible material disposed under a second layer of flexible material that is not adapted to reflect a portion of incident radar energy back toward its source.

2. The radar reflective garment of claim 1 wherein said second layer includes an exterior surface that includes means for providing a desired appearance.

3. A radar reflective garment, comprising:

(a) a first inner layer that is substantially flexible and which is adapted to reflect a portion of incident radar energy; and (b) a second outer layer that is disposed over said first inner layer, said second outer layer not being adapted to reflect a substantial portion of incident radar energy.

4. The radar reflective garment of claim 3 wherein said second outer layer is disposed adjacent with respect to said first inner layer.

5. The radar reflective garment of claim 4 wherein said second outer layer is bonded to said first inner layer.

6. The radar reflective garment of claim 3 wherein said second outer layer is disposed a predetermined distance away from said first inner layer sufficient to create a space therebetween.

7. The radar reflective garment of claim 6 wherein an additional material is disposed in said space intermediate said first inner layer and said second outer layer.

8. The radar reflective garment of claim 7 wherein said additional material is substantially transparent to radar energy.

9. The radar reflective garment of claim 7 wherein said additional material includes means for providing floatation.

10. The radar reflective garment of claim 7 wherein said additional material includes means for providing insulation.

11. The radar reflective garment of claim 7 wherein said additional material includes a plastic foam.

12. The radar reflective garment of claim 3 wherein said first inner layer includes a polymeric film which includes on one of its faces a metalization.

13. The radar reflective garment of claim 3 wherein said first inner layer provides a substantial resistance to air passing the therethrough.

14. The radar reflective garment of claim 3 wherein said garment includes a vest.

15. The radar reflective garment of claim 3 wherein said second outer layer includes a fabric material.

* * * * *